US007032556B2

(12) United States Patent
Nakamura

(10) Patent No.: US 7,032,556 B2
(45) Date of Patent: Apr. 25, 2006

(54) INTAKE ARRANGEMENT FOR INTERNAL COMBUSTION ENGINE

(75) Inventor: Katsuyuki Nakamura, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/960,702

(22) Filed: Oct. 8, 2004

(65) Prior Publication Data

US 2005/0076874 A1 Apr. 14, 2005

(30) Foreign Application Priority Data

Oct. 10, 2003 (JP) ..... 2003-351578

(51) Int. Cl.
*F02M 35/10* (2006.01)

(52) U.S. Cl. ..... 123/184.24; 123/572; 123/568.11

(58) Field of Classification Search ..... 123/184.24, 123/184.34, 184.42, 184.47
See application file for complete search history.

(56) References Cited

U.S. PATENT DOCUMENTS

| | | | | |
|---|---|---|---|---|
| 3,742,923 | A * | 7/1973 | Oblander et al. | 123/572 |
| 4,409,934 | A * | 10/1983 | Kaindl | 123/184.42 |
| 5,713,323 | A * | 2/1998 | Walsh et al. | 123/184.42 |
| 6,095,105 | A | 8/2000 | Lohr | |
| 6,192,848 | B1 * | 2/2001 | Hada et al. | 123/184.24 |
| 6,263,850 | B1 | 7/2001 | Winmill et al. | |
| 6,334,437 | B1 | 1/2002 | Jessberger | |
| 6,340,011 | B1 | 1/2002 | Jainek | |
| 6,422,221 | B1 | 7/2002 | Pietrowski et al. | |
| 6,758,191 | B1 * | 7/2004 | Vanderveen et al. | 123/456 |
| 6,776,132 | B1 * | 8/2004 | Kudo et al. | 123/184.42 |
| 6,807,957 | B1 * | 10/2004 | Ko | 123/572 |

FOREIGN PATENT DOCUMENTS

| | | | |
|---|---|---|---|
| DE | 196 36 579 | A1 | 3/1997 |
| EP | 1 074 732 | A2 | 2/2001 |
| EP | 1 264 982 | A1 | 12/2002 |
| JP | 10-61510 | A | 3/1998 |
| JP | 2001-123901 | A | 5/2001 |

* cited by examiner

*Primary Examiner*—Marguerite McMahon
(74) *Attorney, Agent, or Firm*—Foley & Lardner LLP

(57) ABSTRACT

An intake arrangement for an internal combustion engine, including an intake manifold including an intake collector disposed above the engine body, a plurality of branch pipes extending from the intake collector to an intake side of the engine body over above the engine body in a curved state, and a connecting wall disposed between the branch pipes. The branch pipes extend in a direction substantially perpendicular to a longitudinal direction of the intake collector and are arranged with space between adjacent ones of the branch pipes. The connecting wall covers the space between the adjacent ones of the branch pipes and coextends with the branch pipes. The connecting wall has an outside air introducing opening opposed to the intake side of the engine body.

19 Claims, 6 Drawing Sheets

INTAKE ARRANGEMENT FOR INTERNAL COMBUSTION ENGINE

BACKGROUND OF THE INVENTION

The present invention relates to an intake arrangement for an internal combustion engine.

Japanese Patent Application First Publication No. 10-61510 discloses an intake arrangement for a so-called transverse engine in which an intake side of the engine is disposed on a front side of a vehicle, and an exhaust side of the engine is disposed on a rear side of the vehicle. In the intake arrangement, an intake manifold is connected to a vehicle-front side, namely, the intake side of the engine, and an exhaust manifold is connected to a vehicle-rear side, namely, the exhaust side of the engine.

SUMMARY OF THE INVENTION

In the above-described related art, outside air flowing from the vehicle-front side is disturbed by the engine body and prevented from flowing toward an exhaust system arranged on the exhaust side of the engine. Therefore, the temperature of the exhaust system is prevented from being suitably cooled. This will cause parts disposed in the periphery of the exhaust system to suffer from heat emitted from the exhaust system and adverse influence of the heat.

It is an object of the present invention to provide an intake arrangement for an internal combustion engine, capable of introducing an outside air from the vehicle-front side into a space between an intake manifold and the engine and flowing through the space to near an exhaust system on the exhaust side of the engine, to thereby effectively cool parts arranged around the exhaust system.

In one aspect of the present invention, there is provided an intake arrangement for an internal combustion engine, comprising:

an intake manifold comprising:

an intake collector disposed above an engine body of the engine;

a plurality of branch pipes extending from the intake collector to an intake side of the engine body above the engine body in a curved state, the plurality of branch pipes extending in a direction substantially perpendicular to a longitudinal direction of the intake collector and being arranged with space between adjacent ones of the plurality of branch pipes; and a connecting wall disposed between the plurality of branch pipes so as to cover the space between the adjacent ones of the plurality of branch pipes, the connecting wall coextending with the plurality of branch pipes and having an outside air introducing opening opposed to the intake side of the engine body.

In a further aspect of the present invention, there is provided an intake arrangement for an internal combustion engine, comprising:

an intake manifold comprising:

an intake collector disposed above an engine body of the engine;

a plurality of branch pipes extending from the intake collector to an intake side of the engine body above the engine body in a curved state, the plurality of branch pipes extending in a direction substantially perpendicular to a longitudinal direction of the intake collector and being arranged with space between adjacent ones of the plurality of branch pipes; and wall means for covering the space between adjacent ones of the plurality of branch pipes, the wall means defining an outside air introducing opening, and the intake manifold cooperating with the engine body to define therebetween an outside air path for transporting outside air introduced from the outside air introducing opening to an exhaust side of the engine body.

DETAILED DESCRIPTION OF THE INVENTION

In the followings, embodiments of the present invention will be described with reference to the accompanying drawings. For ease of understanding, various directional terms, such as right, left, upper, lower, upward, downward and the like will be used in the following descriptions. Such terms are to be understood with respect to only drawing or drawings in which the corresponding part is illustrated.

Figure 1:
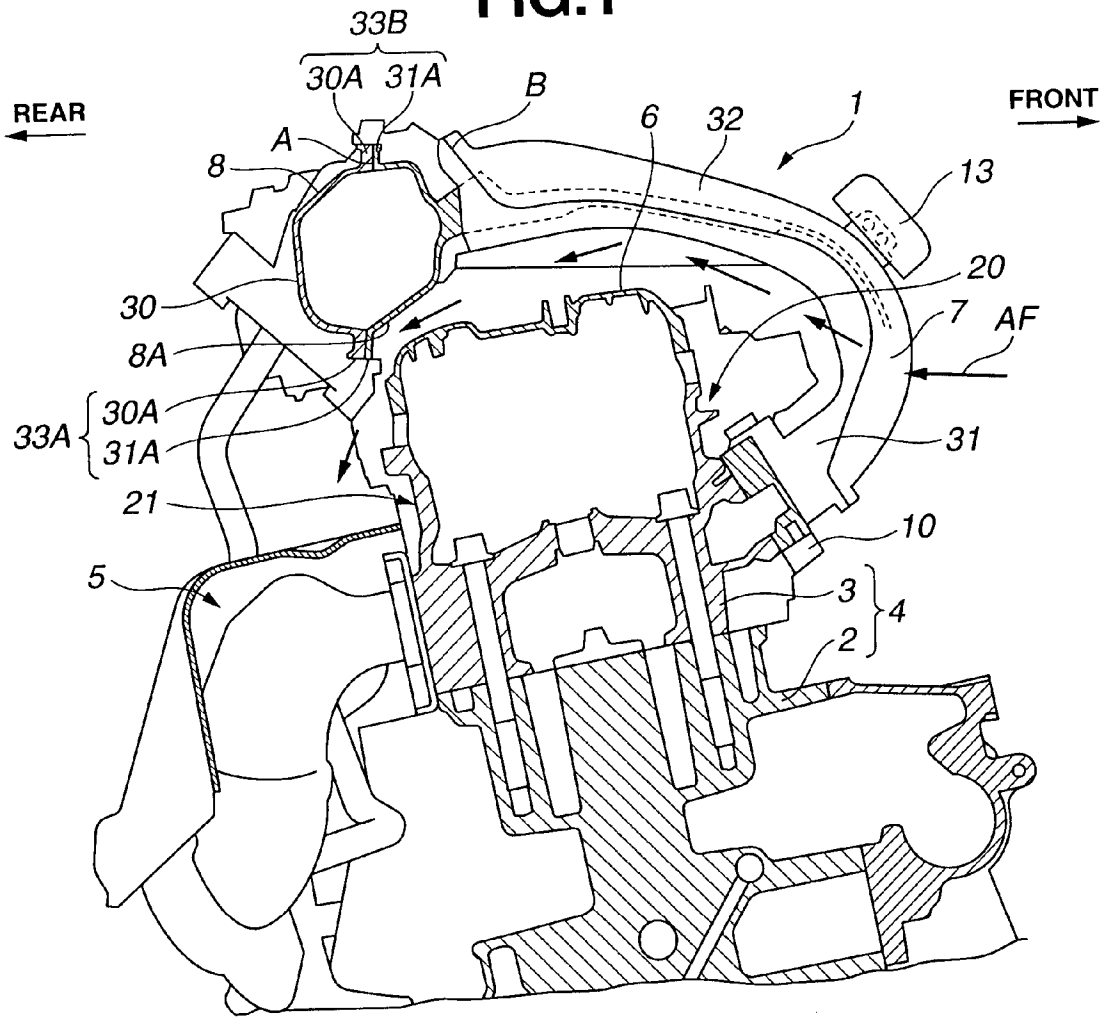
FIG. 1 is an explanatory diagram schematically illustrating an intake arrangement of a first embodiment according to the present invention, together with an internal combustion engine.

Referring to FIGS. 1–5, an intake arrangement of a first embodiment of the present invention is explained. In this embodiment, the intake arrangement is applied to an in-line four-cylinder engine. Specifically, as illustrated in FIG. 1, the engine is installed at a transverse state in which intake side 20 of the engine is disposed on a front side of a vehicle, and exhaust side 21 of the engine is disposed on a rear side of the vehicle.

As illustrated in FIG. 1, the engine includes engine body 4 formed by cylinder block 2 and cylinder head 3. Cylinder block 2 has four engine cylinders, not shown, therein. Cylinder head 3 has intake ports, not shown, and exhaust ports, not shown, therein. Intake manifold 1 that is a part of an intake system is connected to intake side 20 of engine body 4. Intake manifold 1 is made of a suitable resin material. Exhaust manifold 5 that is a part of an exhaust system is connected to exhaust side 21 of engine body 4. A valve operating mechanism, not shown, including a camshaft, cam gears and the like, is arranged within an upper portion of cylinder head 3. Rocker cover 6 extends over the valve operating mechanism.

Figure 2:
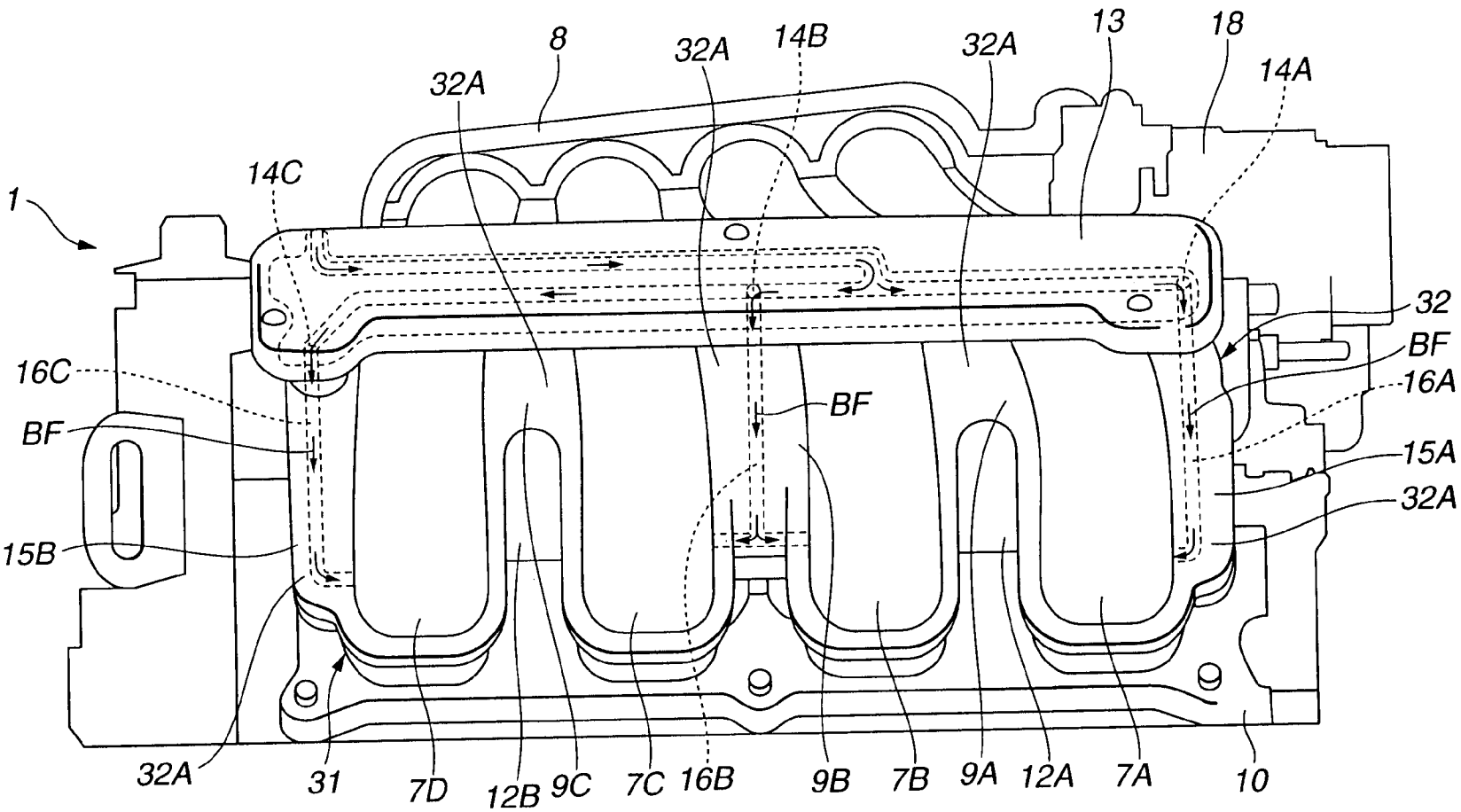
FIG. 2 is a front view of the intake arrangement of the first embodiment.

Intake manifold 1 includes intake collector 8 and branch portion 7 connected with intake collector 8. Intake collector 8 is formed into a generally box shape elongated along a direction of a row of the engine cylinders of engine body 4. Intake collector 8 has a longitudinal end connected with throttle chamber 18 that accommodates a throttle valve, not shown. Branch portion 7 extends from intake collector 8 to intake side 20 of engine body 4 in a generally U-shape curved state as shown in FIG. 1. Branch portion 7 includes four branch pipes 7A, 7B, 7C and 7D as shown in FIG. 2. Branch pipes 7A–7D extend in a direction substantially perpendicular to the longitudinal direction of intake collector 8 and arranged with space between adjacent ones of branch pipes 7A–7D. Branch pipes 7A–7D have upstream end portions connected with intake collector 8 and downstream end portions connected with intake ports, not shown, formed on intake side 20 of engine body 4.

Branch pipes 7A, 7B, 7C and 7D define thereinside intake air passages for delivering intake air to the corresponding engine cylinders. The downstream end portions of branch pipes 7A–7D are connected with one another through mounting flange 10 having a generally rectangular plate shape that extends in the direction of the row of the engine cylinders. Mounting flange 10 is mounted to intake side 20 of engine body 4, namely, a vehicle-front side of cylinder head 3. Disposed upstream of mounting flange 10 are tumble control valves 11 shown in FIG. 5, which are provided for controlling tumble generated in a combustion chamber of each of the engine cylinders of engine body 4. Tumble control valves 11 are disposed within the downstream end portions of branch pipes 7A–7D.

Connecting walls 9A, 9B and 9C are disposed between the adjacent ones of branch pipes 7A–7D so as to cover the space therebetween and connect branch pipes 7A–7D. Connecting walls 9A–9C substantially coextend with branch pipes 7A–7D to curve in the generally U-shape. When intake manifold 1 is coupled to intake side 20 of engine body 4, branch pipes 7A–7D and connecting walls 9A–9C extend between intake collector 8 and intake side 20 of engine body 4 in the curved state. Specifically, branch pipes 7A–7D and connecting walls 9A–9C extend to the vehicle-front side of cylinder head 3 over above rocker cover 6 mounted to an upper portion of cylinder head 3. In other words, branch pipes 7A–7D and connecting walls 9A–9C are curved so as to extend over above engine body 4 to intake side 20 of engine body 4. In the state shown in FIG. 1, intake collector 8 is located above cylinder head 3, specifically, above rocker cover 6.

Figure 4:
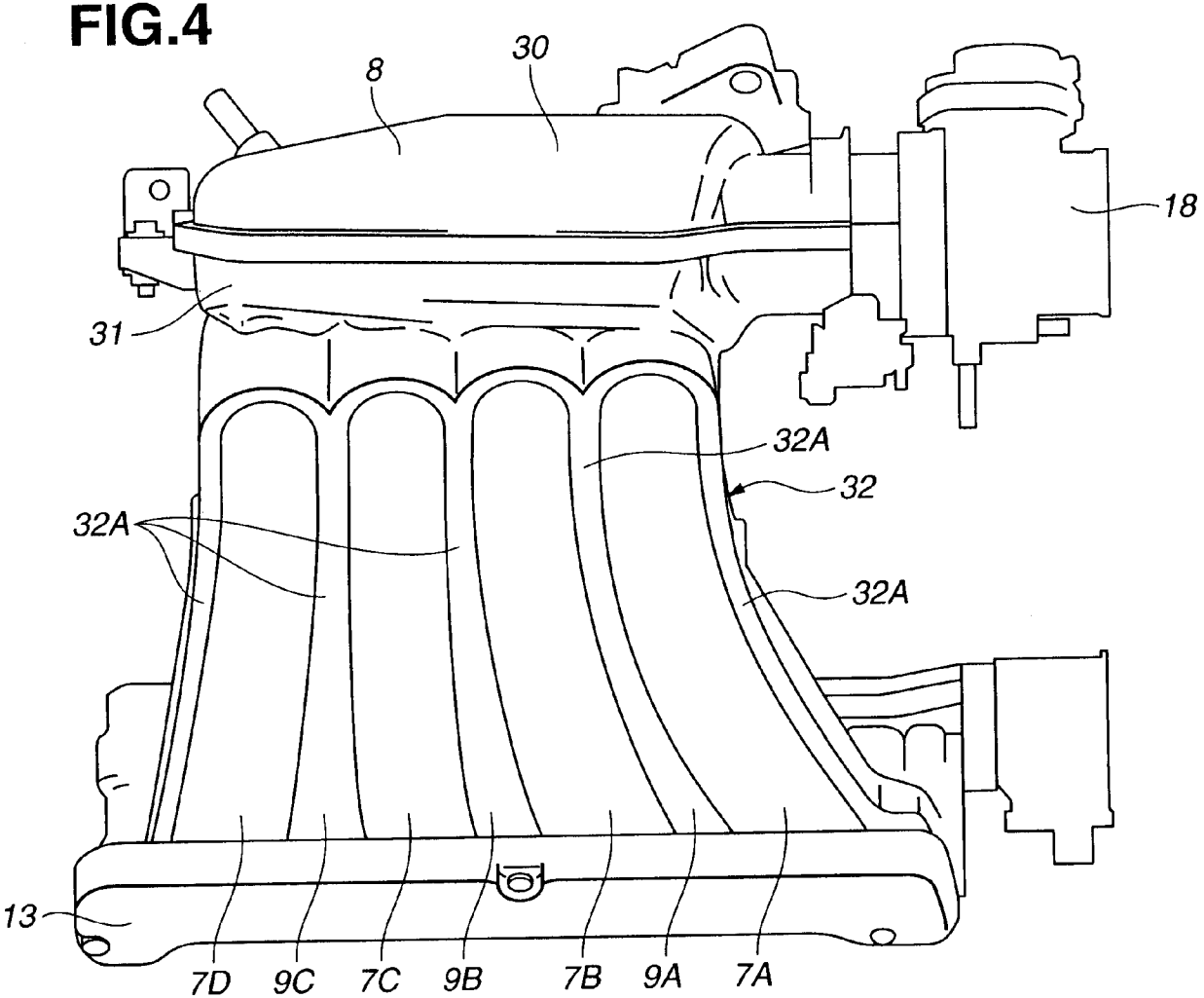
FIG. 4 is a top plan view of the intake arrangement of the first embodiment.

At an upper portion of intake manifold 1 which is opposed to rocker cover 6 as shown in FIG. 4, branch pipes 7A–7D are connected with one another through connecting walls 9A–9C such that the clearance between adjacent branch pipes 7A–7D is covered. On a vehicle-front side of intake manifold 1, namely, on a downstream side thereof, outside air introducing opening 12A is formed in connecting wall 9A between branch pipes 7A and 7B, and outside air introducing opening 12B is formed in connecting wall 9C between branch pipes 7C and 7D. That is, outside air introducing openings 12A and 12B are respectively located between branch pipes 7A and 7B and branch pipes 7C and 7D and opposed to intake side 20 of engine body 4. There is provided no outside air introducing opening between branch pipes 7B and 7C. Connecting wall 9B extends between branch pipes 7B and 7C and covers the space therebetween over an entire axial length of branch pipes 7B and 7C extending from intake collector 8 to the downstream end portions connected with mounting flange 10. Branch pipes 7B and 7C are thus connected with each other over the entire axial length through connecting wall 9B.

Intake manifold 1 further includes gas passage unit 13 for delivering secondary addition gas to the intake system. As illustrated in FIG. 2, gas passage unit 13 is mounted onto branch pipes 7A–7D along such a direction as to extend across branch pipes 7A–7D. Gas passage unit 13 has a flat and elongated shape and includes a gas passage as indicated by broken line. Gas passage unit 13 is formed with three gas outlets 14A, 14B and 14C. A blowby gas pipe, not shown, is connected with gas passage unit 13 so that blowby gas is delivered to the engine cylinders via the gas passage of gas passage unit 13. As indicated by arrow BF in FIG. 2, the blowby gas introduced into the gas passage of gas passage unit 13 flows through gas outlets 14A and 14C into gas passages 16A and 16C formed in peripheral walls 15A and 15B of branch pipes 7A and 7D, and gas passage 16B formed in connecting wall 9B between branch pipes 7B and 7C.

Figure 5:
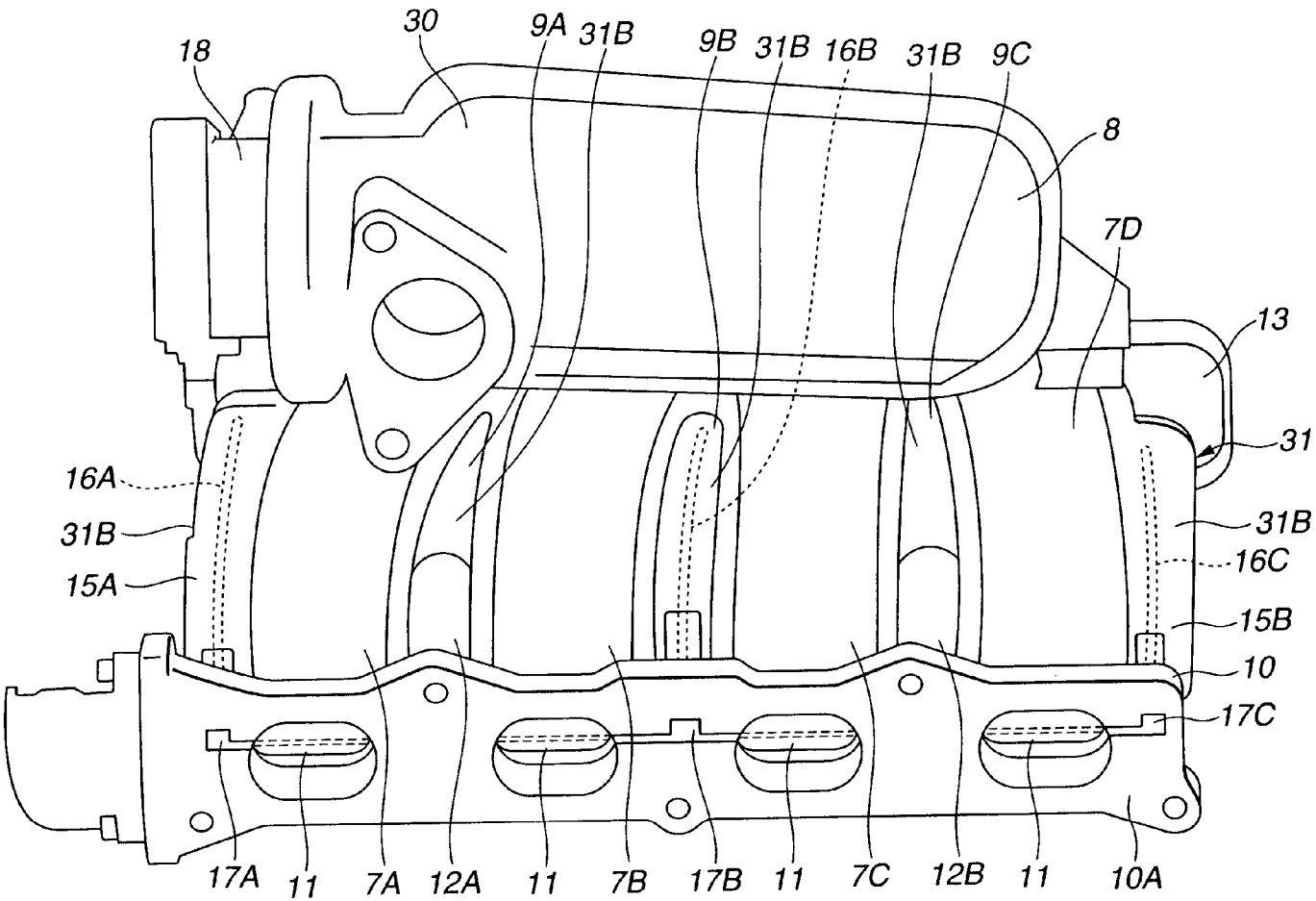
FIG. 5 is a rear view of the intake arrangement of the first embodiment.

Specifically, gas passage 16A is formed substantially in downstream-side peripheral wall 15A of branch pipe 7A which extends outwardly along a downstream side periphery of branch pipe 7A. Gas passage 16A is connected with gas passage 17A formed on flange surface 10A of mounting flange 10 as shown in FIG. 5. Gas passage 17A extends to an aperture that is formed in mounting flange 10 in alignment with an intake air outlet at the downstream end of branch pipe 7A. The blowby gas passing through gas passage 16A is introduced into the intake system via gas passage 17A. Gas passage 16B is formed in connecting wall 9B between branch pipes 7B and 7C and extends along connecting wall 9B in the axial direction of branch pipes 7B and 7C. Gas passage 16B is connected with gas passage 17B formed on flange surface 10A of mounting flange 10 as shown in FIG. 5. Gas passage 17B extends to apertures that are formed in mounting flange 10 in alignment with intake air outlets at the downstream ends of branch pipes 7B and 7C, respectively. The blowby gas passing through gas passage 16B is introduced into the intake system via gas passages 17B. Gas passage 16C is formed substantially in downstream-side peripheral wall 15B of branch pipe 7D which extends outwardly along a downstream side periphery of branch pipe 7D. Gas passage 16C is connected with gas passage 17C formed on flange surface 10A of mounting flange 10 as shown in FIG. 5. Gas passage 17C extends to an aperture that is formed in mounting flange 10 in alignment with an intake air outlet at the downstream end of branch pipe 7D. The blowby gas passing through gas passage 16C is introduced into the intake system via gas passage 17C. Gas passages 16A and 16C extend along peripheral walls 15A and 15B of branch pipes 7A and 7D, and gas passage 16B extends along connecting wall 9B between branch pipes 7B and 7C. Peripheral walls 15A and 15B are provided on outer-most branch pipes, namely, in this embodiment, branch pipes 7A and 7D among four branch pipes 7A–7D, located in opposite outer-most positions in the direction of the row of the engine cylinders, namely, in substantially the longitudinal direction of intake collector 8.

Figure 3:
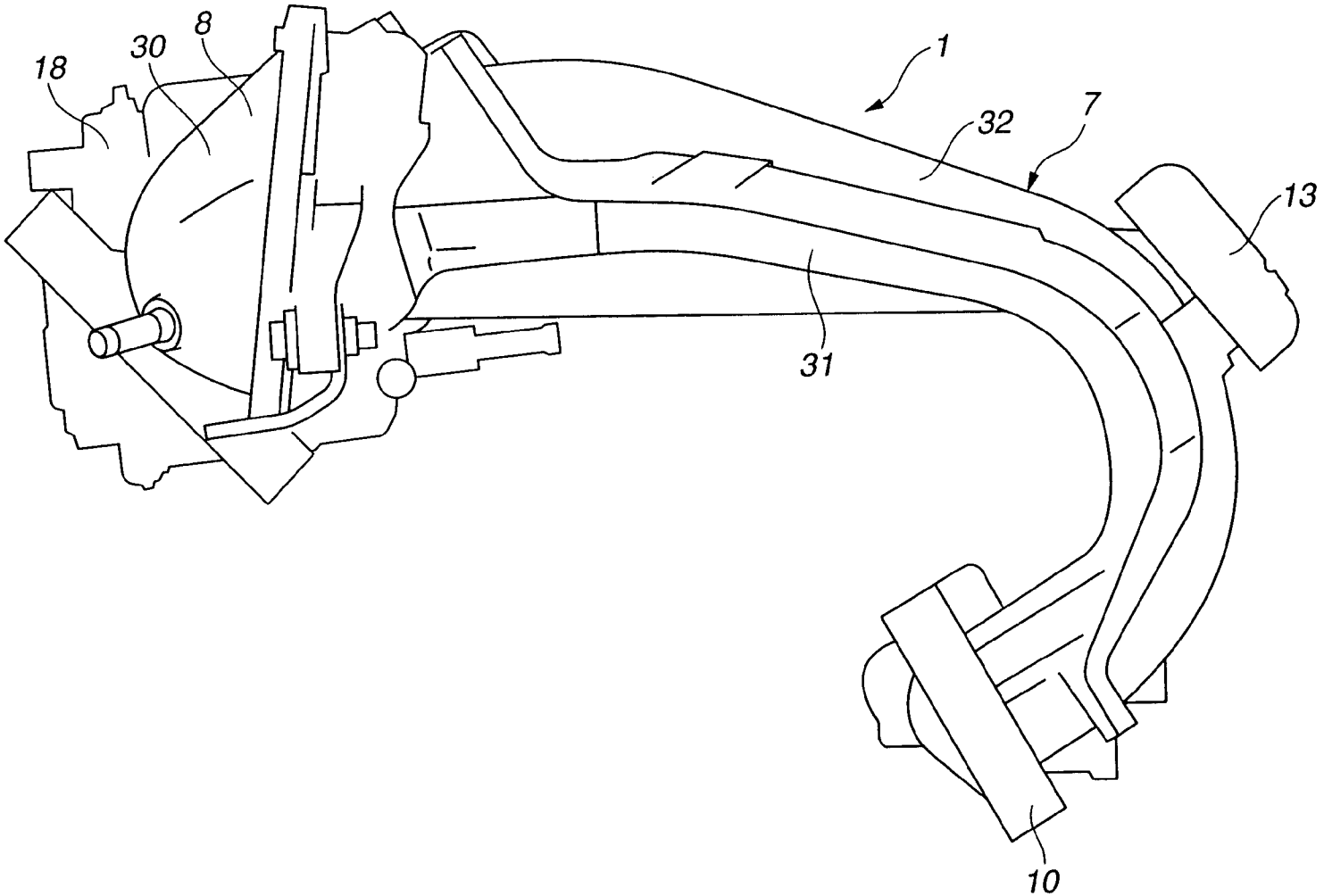
FIG. 3 is a side view of the intake arrangement of the first embodiment.

As shown in FIGS. 1 and 3, intake manifold 1 is constituted of three split parts 30, 31 and 32 separable on split planes A and B. Split parts 30, 31 and 32 made of suitable resin material and produced by die forming are joined by means of vibration welding. Specifically, split part 30 forms a part of intake collector 8, namely, a substantially left half thereof as shown in FIG. 1. Split part 31 forms a remaining part of intake collector 8, namely, a substantially right half thereof as shown in FIG. 1, and a part of each of branch pipes 7A–7D, namely, a substantially lower half of branch portion 7 as shown in FIG. 1. Split part 32 forms a remaining part of each of branch pipes 7A–7D, namely, a substantially upper half of branch portion 7 as shown in FIG. 1.

As shown in FIG. 1, split part 30 has mating portions 30A extending upwardly and downwardly, respectively. Split part 31 has mating portions 31A extending upwardly and downwardly, respectively. Mating portions 30A and 31A are in the form of peripheral flanges of split parts 30 and 31 and extend over a substantially entire length of intake collector 8 in the longitudinal direction of intake collector 8. Mating portions 30A and 31A form collector joint portions 33A and 33B serving for joining split parts 30 and 31. Collector joint portions 33A and 33B extend along a direction of the intake air flow flowing in intake collector 8. Collector joint portions 33A and 33B have mating faces mutually contacted, on which split plane A is located. Intake collector 8 is formed by joining mating portions 30A of split part 30 and mating portions 31A of split part 31 by means of vibration welding.

Intake collector 8 includes bottom wall 8A formed by split part 31. When intake manifold 1 is mounted to cylinder head 3 as shown in FIG. 1, bottom wall 8A is opposed to an upper surface of rocker cover 6 and inclined in such a manner that a vehicle-rear side of bottom wall 8A is located close to cylinder head 3 as compared to a vehicle-front side thereof. In other words, bottom wall 8A is opposed to an upper portion of cylinder head 3 and inclined in such a manner that the vehicle-rear side of bottom wall 8A is located close to exhaust side 21 of engine body 4 as compared to the vehicle-front side thereof.

Collector joint portion 33A projects toward engine body 4 so as to be oriented to exhaust manifold 5 as a part of the exhaust system which is located on exhaust side 21 of engine body 4. Therefore, collector joint portion 33A also acts as an outside air guide portion guiding the outside air introduced through outside air introducing openings 12A and 12B toward exhaust side 21 of engine body 4.

As illustrated in FIGS. 2, 4 and 5, branch pipes 7A–7D are formed by joining mating portion 31B of split part 31 and mating portion 32A of split part 32 by means of vibration welding. Mating portions 31B and 32A are in the form of peripheral flanges of split parts 31 and 32. Mating portion 31B of split part 31 and mating portion 32A of split part 32 cooperate to form connecting walls 9A–9C and peripheral walls 15A and 15B of branch pipes 7A and 7D. Gas passages 16A–16C are substantially formed on mating faces of mating portions 31*b* and 32A of split parts 31 and 32. Specifically, each of gas passages 16A–16C is substantially formed on the mating faces of mating portions 31*b* and 32A and partially formed in a portion of split part 31 which forms the downstream end portion of branch portion 7 located near mounting flange 10. The part of each of gas passages 16A–16C formed in the portion of split part 31 is connected with the corresponding gas passage 17A, 17B and 17C formed on flange surface 10A of mounting flange 10.

Thus-constructed intake manifold 1 cooperates with engine body 4 to define therebetween an outside air path for transporting outside air introduced from outside air introducing opening 12A and 12B to exhaust side 21 of engine body 4. Specifically, the outside air path is formed between cylinder head 3, rocker cover 6 and a lower side surface of intake manifold 1 which is formed by branch portion 7, connecting walls 9A–9C and intake collector 8. As illustrated in FIG. 1, outside air flow AF flowing from the vehicle-front side is introduced into the outside air path through outside air introducing openings 12A and 12B. Outside air flow AF introduced flows through the outside air path along the lower side surface of intake manifold 1. Outside air flow AF is then guided toward exhaust side 21 of engine body 4 and transported to near exhaust manifold 5. As a result, parts disposed around exhaust manifold 5 can be effectively cooled by outside air flow AF introduced and transported through the outside air path. The parts disposed around exhaust manifold 5, therefore, can be prevented from suffering from heat emitted by exhaust manifold 5.

Further, bottom wall 8A of intake collector 8 is inclined toward exhaust side 21 of engine body 4. That is, the outside air path is tapered toward exhaust side 21 of engine body 4, so that outside air flow AF introduced from outside air introducing openings 12A and 12B can be guided toward exhaust side 21 of engine body 4. Further, collector joint portion 33A projects toward engine body 4 so as to be oriented to exhaust manifold 5. This can more effectively guide outside air flow AF flowing along bottom wall 8A of intake collector 8 to the vicinity of exhaust manifold 5 without increasing the numbers of parts.

Further, with the provision of gas passages 16A and 16C in downstream-side peripheral walls 15A and 15B of outermost branch pipes 7A and 7D and gas passage 16B in connecting wall 9B, blowby gas introduced into gas passages 16A–16C can be delivered to near cylinder head 3 without using a separate pipe or tube member. This serves for reducing the production cost and improving the productivity. Further, gas passages 17A–17C are provided downstream of branch portion 7 of intake manifold 1, and specifically, on flange surface 10A of mounting flange 10 mounted to cylinder head 3. With this arrangement, an intake air passage of the intake system can be prevented from being fouled by the blowby gas introduced thereinto.

Gas passage unit 13 and gas passages 16A–16C and 17A–17C may deliver various kinds of the secondary addition gas, for instance, blowby gas, EGR gas, secondary air and the like.

Figure 6:
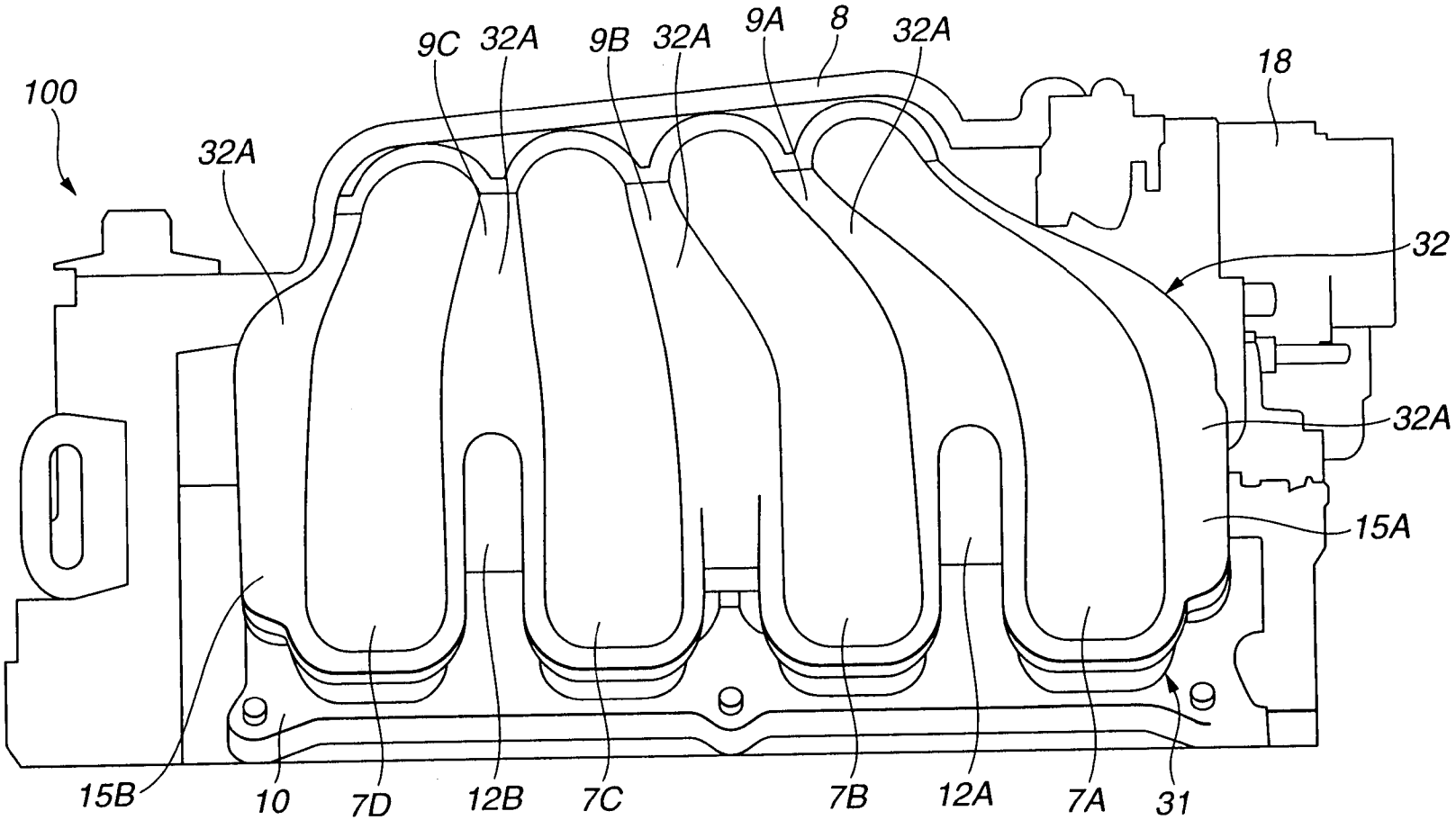
FIG. 6 is a front view of an intake arrangement of a second embodiment according to the present invention.

Referring to FIG. 6, a second embodiment of the intake arrangement of the present invention is explained. As illustrated in FIG. 6, the second embodiment differs in that intake manifold 100 has no gas passage unit and no gas passage in peripheral walls 15A and 15B of branch pipes 7A and 7D and connecting wall 9B, from the first embodiment. Similar to the first embodiment, in the second embodiment, an outside air flow flowing from the vehicle-front side is introduced from outside air introducing openings 12A and 12B into the outside air path between intake manifold 100 and engine body 4. The outside air flow introduced is guided along the lower side surface of intake manifold 100 toward exhaust side 21 of engine body 4 and transported to the vicinity of exhaust manifold 5. Therefore, the second embodiment can perform the effects of cooling parts disposed around exhaust manifold 5 and preventing the parts from suffering from heat emitted from exhaust manifold 5.

In the second embodiment, a plurality of tubular members may be provided for delivering secondary addition gas to the intake system. In such a case, the tubular members are arranged outside and along connecting wall 9B and peripheral walls 15A and 15B of branch pipes 7A and 7D, and one end of each of the tubular members is open into the downstream side of branch portion 7.

This application is based on a prior Japanese Patent Application No. 2003-351578 filed on Oct. 10, 2003. The entire contents of the Japanese Patent Application No. 2003-351578 is hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An intake arrangement for an internal combustion engine, comprising:

an intake manifold comprising:

an intake collector disposed above an engine body of the engine;

a plurality of branch pipes extending from the intake collector to an intake side of the engine body above the engine body in a curved state, the plurality of branch pipes extending in a direction substantially perpendicular to a longitudinal direction of the intake collector and being arranged with space between adjacent ones of the plurality of branch pipes; and a connecting wall disposed between the plurality of branch pipes so as to cover the space between the adjacent ones of the plurality of branch pipes, the connecting wall coextending with the plurality of branch pipes and having an outside air introducing opening opposed to the intake side of the engine body; and wherein the intake manifold cooperates with the engine body to define therebetween an outside air path for transporting outside air introduced from the outside air introducing opening to an exhaust side of the engine body.

2. The intake arrangement as claimed in claim 1, wherein the intake manifold is adapted for a transverse engine in which the intake side of the engine body is located on a front side of a vehicle.

3. The intake arrangement as claimed in claim 1, further comprising a gas passage for delivering secondary addition gas to be supplied to an intake system in the engine, the gas passage being formed along the connecting wall.

4. The intake arrangement as claimed in claim 1, further comprising gas passages for delivering secondary addition gas to an intake system in the engine, the gas passages being open to a downstream side of the branch pipes, the gas passages being formed along peripheral walls of the branch pipes.

5. The intake arrangement as claimed in claim 3, wherein the connecting wall comprises a first connecting wall having the gas passage and a second connecting wall having no gas passage, the outside air introducing opening being formed in the second connecting wall, the first connecting wall substantially covering the intake side of the engine body.

6. The intake arrangement as claimed in claim 4, wherein the peripheral walls are provided on the branch pipes located in opposite outer-most positions in the longitudinal direction of the intake collector.

7. The intake arrangement as claimed in claim 1, wherein the intake collector comprises an outside air guide portion for guiding the outside air introduced through the outside air introducing opening toward an exhaust side of the engine body.

8. The intake arrangement as claimed in claim 7, wherein the outside air guide portion of the intake collector comprises a bottom wall opposed to the exhaust side of the engine body in an inclined state inclined toward the exhaust side thereof.

9. The intake arrangement as claimed in claim 7, wherein the outside air guide portion of the intake collector comprises a collector joint portion projecting toward the engine body so as to be oriented to a part of an exhaust system in the engine.

10. The intake arrangement as claimed in claim 1, wherein the plurality of branch pipes comprise a first split part and a second split part, the first and second split parts including mating portions extending along a direction of an intake air flow, respectively, the first and second split parts being joined with each other at the mating portions thereof to form the plurality of branch pipes, the mating portions of the first and second split parts forming the connecting wall.

11. The intake arrangement as claimed in claim 9, wherein the plurality of branch pipes comprise a first split part and a second split part, the first split part including first and second mating portions extending along a direction of an intake air flow, the second split part including a third mating portion extending along a direction of an intake air flow, the first and second split parts being joined with each other at the second and third mating portions thereof to form the plurality of branch pipes, the intake collector comprising a third split part including a fourth mating portion extending along a direction of an intake air flow, the first and third split parts being joined with each other at the first and fourth mating portions thereof to form the intake collector, the first and fourth mating portions of the first and third split parts forming the collector joint portion.

12. The intake arrangement as claimed in claim 1, wherein the outside air path is tapered toward the exhaust side of the engine body.

13. The intake arrangement as claimed in claim 3, further comprising a gas passage unit having a gas passage connected with the gas passage formed along the connecting wall, the gas passage unit being mounted onto the branch pipes.

14. The intake arrangement as claimed in claim 4, further comprising a gas passage unit having a gas passage connected with the gas passages formed along the peripheral walls of the branch pipes, the gas passage unit being mounted onto the branch pipes.

15. An intake arrangement for an internal combustion engine, comprising:

an intake manifold comprising:

an intake collector disposed above an engine body of the engine;

a plurality of branch pipes extending from the intake collector to an intake side of the engine body above the engine body in a curved state, the plurality of branch pipes extending in a direction substantially perpendicular to a longitudinal direction of the intake collector and being arranged with space between adjacent ones of the plurality of branch pipes; and wall means for covering the space between adjacent ones of the plurality of branch pipes, the wall means defining an outside air introducing opening, and the intake manifold cooperating with the engine body to define therebetween an outside air path for transporting outside air introduced from the outside air introducing opening to an exhaust side of the engine body.

16. The intake arrangement as claimed in claim 15, wherein the outside air path is tapered toward the exhaust side of the engine body.

17. The intake arrangement as claimed in claim 15, wherein the intake manifold is adapted for a transverse engine in which the intake side of the engine body is located on a front side of a vehicle.

18. The intake arrangement as claimed in claim 15, further comprising passage means for delivering secondary addition gas to be supplied to an intake system, the passage means extending along the wall means.

19. The intake arrangement as claimed in claim 15, further comprising passage means for delivering secondary addition gas to be supplied to an intake system, the passage means extending along peripheral walls of the branch pipes and being open to a downstream side of the branch pipes.

* * * * *